US007571866B2

(12) United States Patent
Buswell et al.

(10) Patent No.: US 7,571,866 B2
(45) Date of Patent: Aug. 11, 2009

(54) HIGH-PRESSURE GAS POWERED FULL BODY SELF MISTING DEVICE

(75) Inventors: Richard E. Buswell, Tampa, FL (US); Julie D. Buswell, Tampa, FL (US)

(73) Assignee: RNJ Enterprises, LLC, Tampa, FL (US)

( * ) Notice: Subject to any disclaimer, the term of this patent is extended or adjusted under 35 U.S.C. 154(b) by 467 days.

(21) Appl. No.: 11/247,316

(22) Filed: Oct. 11, 2005

(65) Prior Publication Data

US 2006/0102746 A1 May 18, 2006

Related U.S. Application Data

(60) Provisional application No. 60/623,113, filed on Oct. 29, 2004.

(51) Int. Cl.
*B05B 9/04* (2006.01)

(52) U.S. Cl. ..... 239/373; 239/266; 239/280; 239/346; 239/550; 239/566; 239/600; 604/289

(58) Field of Classification Search ..... 239/279, 239/280, 266–268, 346, 373, 550, 566; 132/200, 132/333; 604/289
See application file for complete search history.

(56) References Cited

U.S. PATENT DOCUMENTS

| | | | | |
|---|---|---|---|---|
| 6,554,207 | B2 * | 4/2003 | Ebberts | 239/373 |
| 6,554,208 | B1 * | 4/2003 | Venuto, Sr. | 604/289 |
| 7,004,932 | B2 * | 2/2006 | Szurko | 604/289 |
| 7,082,948 | B2 * | 8/2006 | Laughlin | 132/200 |

* cited by examiner

*Primary Examiner*—Steven J Ganey
(74) *Attorney, Agent, or Firm*—Dennis L. Cook, Esq.

(57) ABSTRACT

This disclosure describes a high-pressure gas powered full body self misting device that allows a person to spray a mist onto their whole body at once without using electricity, and without having to hold anything in their hand, such as a can or misting spray wand. This device can be used as a simple, do-it-yourself, misting system for fluids that are commonly applied to or around the body including, but not limited to, tanning solution, skin lotions, and aromatherapy mist.

4 Claims, 3 Drawing Sheets

HIGH-PRESSURE GAS POWERED FULL BODY SELF MISTING DEVICE

CROSS-REFERENCE TO RELATED APPLICATION

The present application claims the benefit of previously filed Provisional Patent Application, Ser. No. 60/623,113, filed Oct. 29, 2004, and incorporates by reference the contents therein.

FIELD OF INVENTION

This invention relates to a system which allows for application of a composition to a person and can be easily used in the user's home, for example a sunless tan applied in the user's own shower, and more specifically for a high-pressure, gas powered, hands free, full body self misting device.

BACKGROUND OF INVENTION

The cosmetic effect of tanned skin has long been a desired goal for many people. This desire has led to the development of a large and varied industry supplying compositions and devices to facilitate natural or UV radiation induced tanning of the skin. Another market has also developed for compositions to more rapidly provide the visual effect of tanned skin without UV radiation exposure. In addition to the development of the multitude of sun tanning, sun screening, and artificial tanning and bronzing lotions, creams, and oils now available, various applicator devices for the different compositions have been devised, ranging from simple squeeze bottles, pump sprays, and aerosols, to hand-held spray systems powered by electric compressors, fans, or pumps, to elaborate spray rooms that generate mists of suntan lotions or artificial tanning compositions for application to a user standing in the room.

These various applicator devices include U.S. Pat. No. 1,982,509 issued to Frank showing a belt-driven carriage apparatus in a vertically oriented cabinet designed to carry, among several alternatives, a compressed air sprayer head and one or more reservoirs for liquid or powder compositions to be spray applied through the sprayer head to all or part of the body of a user standing in front of the apparatus. The '509 patent does not disclose the spray application of tanning compositions, and the single spray nozzle would necessarily result in an uneven application in overlap areas as the user turns for sequential sprayer passes, and/or missed areas under the arms or on the insides of the arms and legs. The belt driven carriage of the '509 patent is raised and lowered along a guide pole in the cabinet with the start and stop positions for the carriage and the activation of the sprayer apparatus being coordinated by a complicated set of electromechanical linkages and trip-switches.

U.S. Pat. Nos. 5,460,192 and 5,664,593, both to McClain, describe variations of an apparatus to coat a user's body up to the neck with suntan lotion or sunscreen. Both variations provide for a cylindrical enclosure in which the user stands with head and neck protruding through a hole in the top of the enclosure. The apparatus of the '192 patent provides for three liquid spray nozzles directed at the shoulder level, the waist level, and at the level of the legs, respectively. When activated by a user, the apparatus sprays a dose of suntan lotion or sunscreen while the user rotates while standing. Excess spray is drained through a grating at the base of the enclosure. The apparatus of the '593 patent atomizes the lotion into a forced-air stream which then enters the enclosure through three ports at the level of the shoulder, the waist, and the legs, respectively. An evacuation fan draws air from within the enclosure through a vent close to the base of the enclosure, creating more air turbulence in the enclosure and also recirculating excess atomized lotion from the air in the enclosure back into the forced-air stream in an effort to more efficiently and more completely coat the user's body. The user's body must still rotate within the enclosure, while the user's neck protrudes through the close fitting hole in the top of the enclosure. The apparatus of the '593 patent also collects condensed over-spray from the recirculated air with the evacuation fan mechanism, as well as draining excess over-spray from the enclosure through a grating in the enclosure base.

U.S. Pat. No. 5,922,333 and others issued to Laughlin generally describe a method of applying a wide variety of fluids to the body, including sunless tanning compositions, by manually directing a spray nozzle at the area to be coated, or preferably, by atomizing the fluid into an air current and directing the air current against the person being coated, and collecting the residual spray through a venting system, preferably including a filtration means.

Still other apparatuses, such as that disclosed in U.S. Pat. No. 6,443,164 issued to Parker, et al., provide for a booth-type enclosure with a multiplicity of fixed spray nozzles at various heights in the corners of the booth. These have fixed or moving nozzles that direct a spray of artificial tanning composition at the user standing in the center of the booth. Upon completion of a spray cycle, an evacuation fan evacuates residual spray from the booth through a filtered venting system.

These devices, along with all other prior art sunless tanning devices and booths presently on the market, have major drawbacks including incomplete and/or streaky application of tanning composition, inefficient use of tanning composition, complicated equipment that requires trained operators to use, and discomfort, including possible embarrassment for the user due to the need to undress and use a public location or have another person's assistance to get a full body tan as compared with the easy hands free and private use in the user's own shower that the device of this disclosure allows.

BRIEF SUMMARY OF THE INVENTION

The high-pressure gas powered full body self misting device, henceforth designated as the device, is an apparatus that allows a person to spray a mist onto their whole body at once without using electricity, and without having to hold anything in their hands, such as a can or misting spray wand. This device can be used as a simple, do-it-yourself, misting system for fluids that are commonly applied to, or around, the body including, but not limited to, tanning solution, skin lotions, and aromatherapy mist.

For operation of the invention, the pressure vessel is first filled with a fluid through the fill valve, which is closed after filling. A gas cartridge is then connected to the gas release valve. When the gas is released via the gas release valve, the high-pressure gas from the gas cartridge pressurizes the fluid in the pressure vessel, which is then forced out through the manifold and further through mist nozzles. Depending on the applied use of the invention, the operator may stand in front of the mist nozzles to apply the mist to their skin.

It is therefore an object of the invention to supply a simple, easy to use spray misting device that a user can use in the privacy of their own home.

For a fuller understanding of the nature and objects of the invention, reference should be made to the following detailed description taken in connection with the accompanying drawings.

BRIEF DESCRIPTION OF DRAWINGS

For a fuller understanding of the nature and objects of the invention, reference should be made to the accompanying drawings, in which.

DESCRIPTION OF PREFERRED EMBODIMENT

Figure 1:
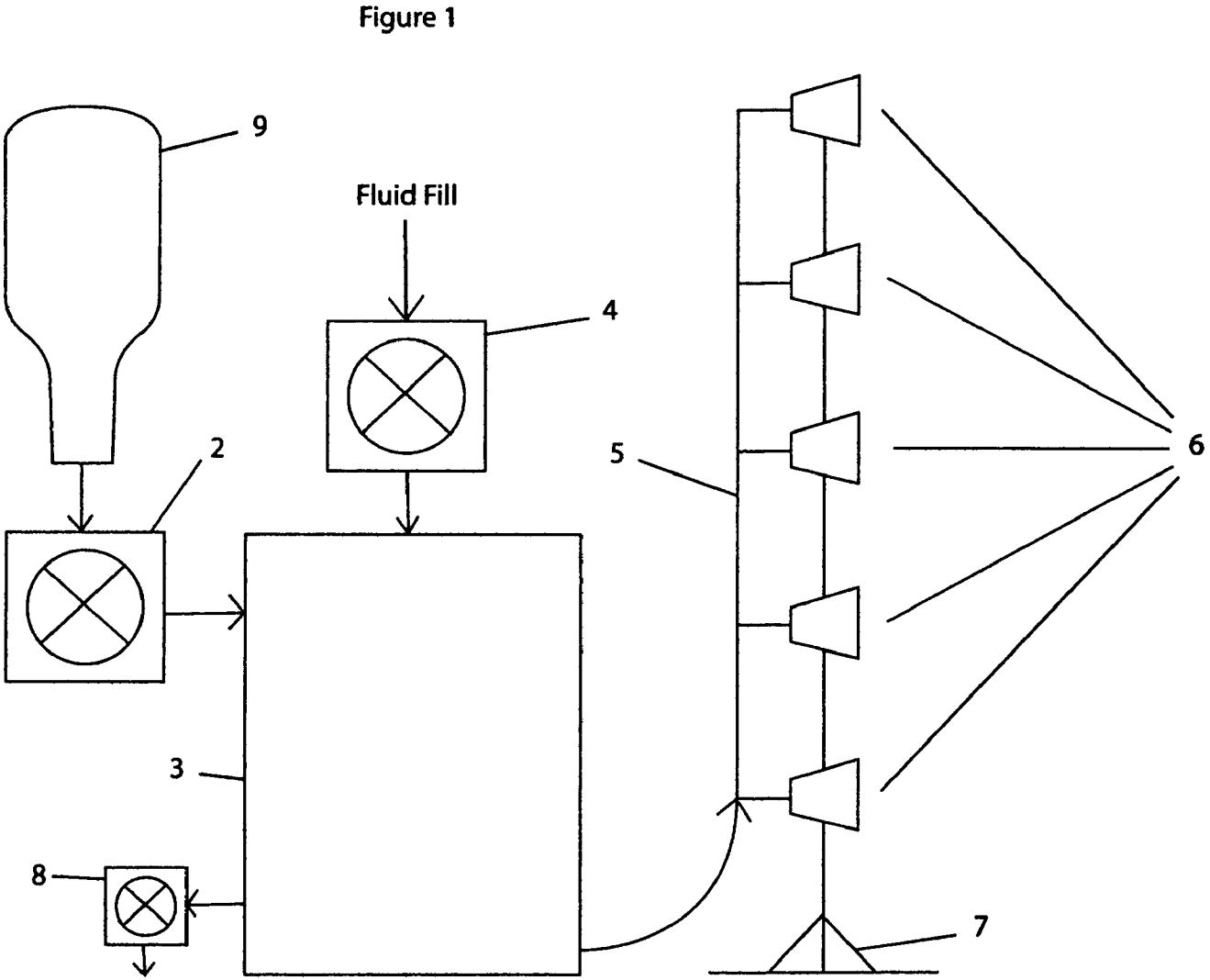
FIG. 1: shows a schematic drawing of the mechanical features of the device.

As shown in the FIG. 1 schematic the basic system components that make up the device (1) include a gas release valve (2), pressure vessel (3), fill valve (4), manifold (5) with mist nozzles (6), nozzle support system (7), and preferably a drain valve (8), although this component is not a necessity for operation. These components are used together with a mistable fluid that has been entered into the pressure vessel (3) through the fill valve (4), and a high-pressure gas cartridge (9), which is used to propel the mistable fluid out of the pressure vessel (3), through the manifold (5), and to the misting nozzles (6).

Figure 2:
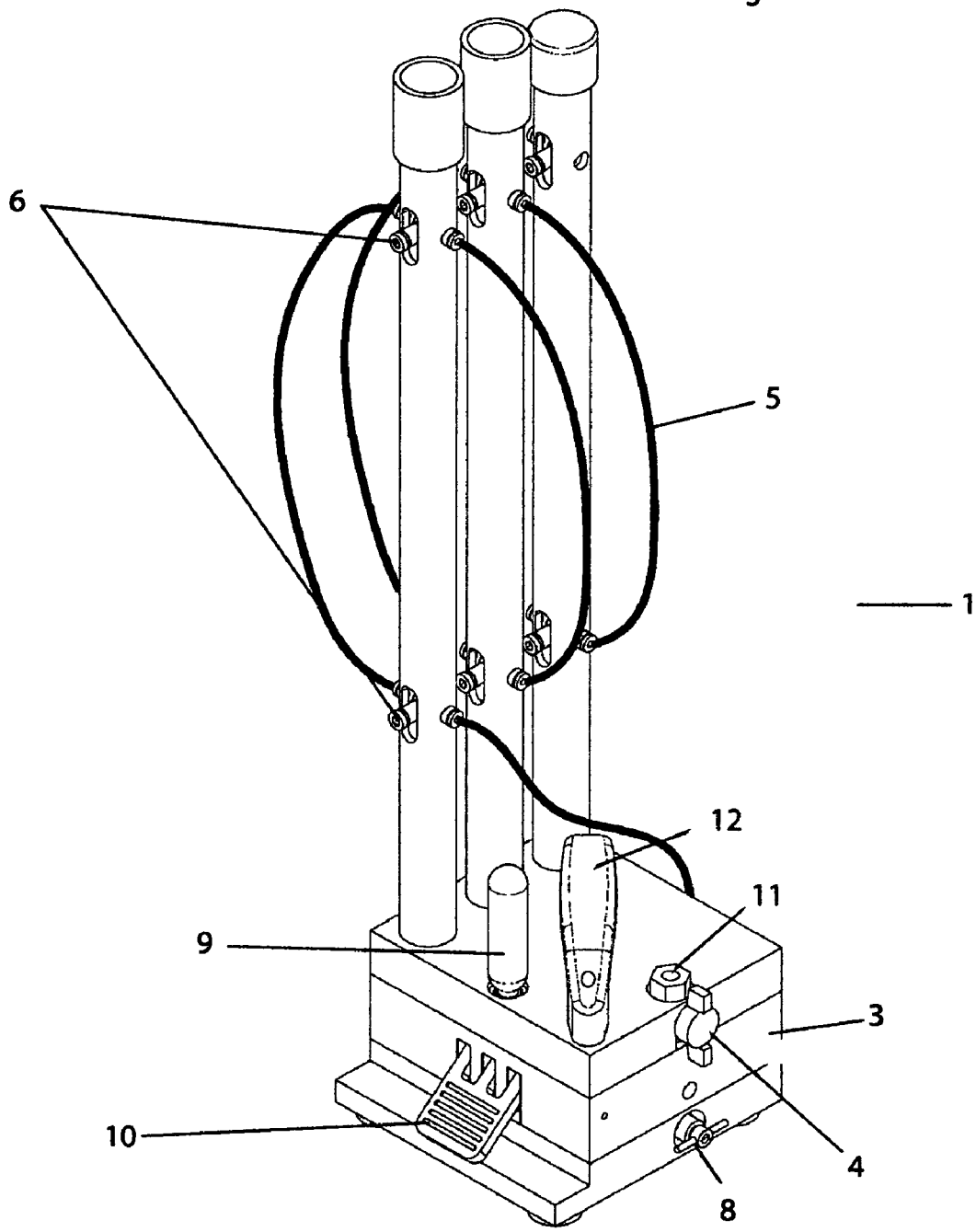
FIG. 2: shows a drawing of the preferred embodiment of the device in a collapsed for easy handling position; and, FIG. 3: shows a drawing of the preferred embodiment of the device in the deployed position.
Figure 3:
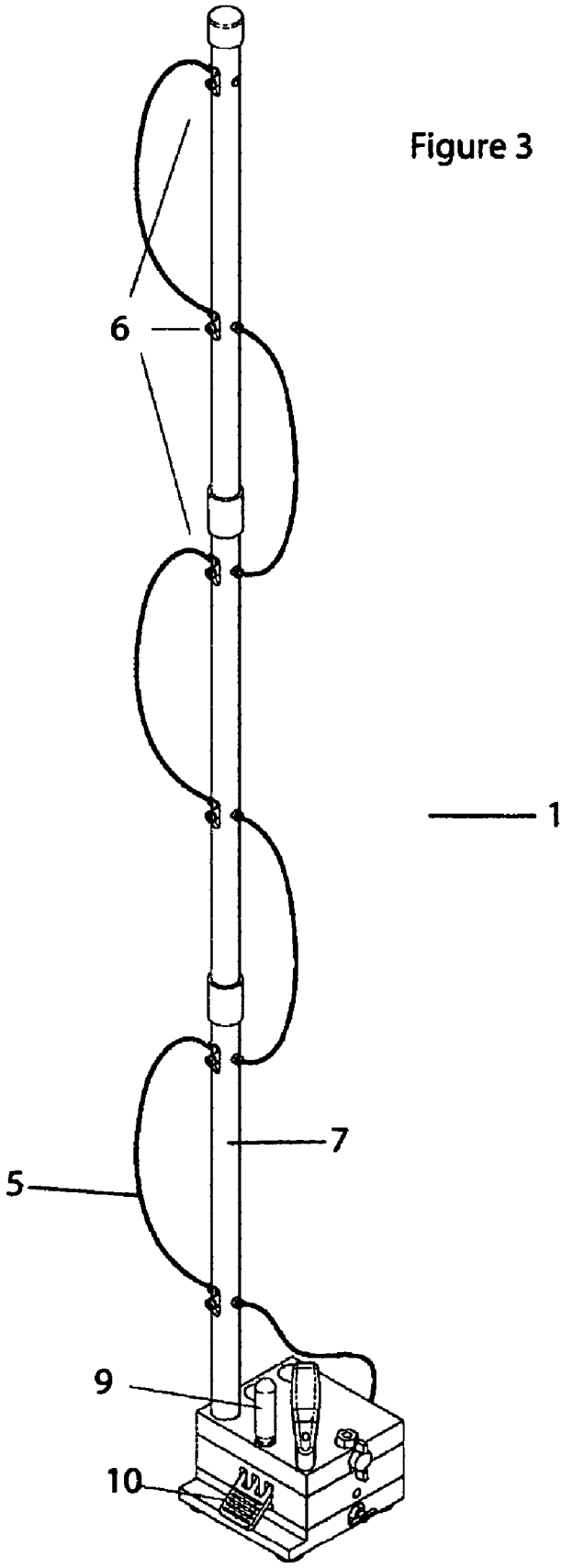

The gas release valve component (2) can be as simple as a fixed puncture pin (not shown) that pierces a gas cartridge (9) when it is pressed against the pin, or, as shown on FIGS. 2 and 3, it can consist of a movable puncture pin (not shown) connected to an actuation device (10) such as a foot pedal. The gas release valve (2) can be a separate component connected to the pressure vessel (3) through high-pressure pipe or tubing, or it can be directly connected or integral to the pressure vessel (3) as shown in the preferred embodiment.

The pressure vessel (3) is a container that is capable of holding the fluid added by a user and is also capable of being pressurized with gas, which comes from the gas cartridge (9) when released by the gas release valve (2), to expel the fluid at a high pressure. The pressure vessel (3) can be any size or shape container suitable for holding the pressure of the particular gas cartridges (9) being used (standard commercially available CO2 gas cartridges are pressurized at about 860 psi at room temperature). Other types of gas cartridges can be used as is easily determined by those skilled in the art.

The fluid fill (11) and fill valve (4) allows for the fill of a mistable fluid into the pressure vessel (3). Once the pressure vessel (3) is filled the fill valve (4) is closed before the gas release valve (2) is activated so the fluid and/or gas cannot escape back through the fill valve (4) and is instead propelled through the manifold (5) and out through the misting nozzles (6). The fill valve (4) can simply be a threaded port into the pressure vessel (3) with a threaded plug for closure, or it can consist of a high-pressure ball, or other type, open/close valve well known by those skilled in the art. The fill valve (4) could also be a separate component connected to the pressure vessel (3) through high-pressure pipe or tubing, or it can be directly connected or integral to the pressure vessel (3). The fill valve (4) could also be integral to the gas release valve (2).

The manifold (5) connects the mist nozzles (6) that are simply a series of one or more misting nozzles connected in parallel or in series through a high-pressure piping or tubing manifold. The mist nozzles (6) are held in a fixed position by a nozzle support system (7), which can consist of, but is not limited to, the nozzle manifold (5) itself, suction cups (not shown) used in conjunction with a wall or other smooth surface, or a rigid structure that the mist nozzles (6) attach to. As shown in FIGS. 2 and 3, the preferable rigid nozzle support system (7) design made from plastic pipe in the preferred embodiment allows for collapsing for easier packaging and storage.

The drain valve (8) is not an essential component of the device (1) because it is not needed for proper functioning of the device (1) but the addition of this drain valve (8) allows for easier drainage, cleaning, and drying out of the device (1). The drain valve (8) can be a separate component connected to the pressure vessel (3) through high-pressure pipe or tubing, or it can be directly connected or integral to the pressure vessel (3). A handle (12) may also be added for easy carriage when the device (1) is in the collapsed position as shown in FIG. 2.

For operation of the device (1), the pressure vessel (3) is first filled with a fluid to be misted via a fluid fill (11) opening and through the fill valve (4), which is closed after filling. Preferably one pre-measured application of mistable fluid is entered into the pressure vessel (3) via the fluid fill (11) and through the fill valve (4). A gas cartridge (9) is then connected to the gas release valve (2) and fluidly connected to the pressure vessel (3). When the gas cartridge (9) is opened by the gas release valve (2), preferably by the user pressing the actuation device (10) such as a foot pedal, the high-pressure gas from the gas cartridge (9) pressurizes the fluid in the pressure vessel (3), such that the fluid is then forced out through the manifold (5) and through the mist nozzles (6) allowing for a one time use of the device (1). Depending on the applied use of the device (1), the operator typically stands in front of the mist nozzles (6) and slowly rotates to apply the mist to their skin. This procedure is repeated for each subsequent use of the device (1).

Since certain changes may be made in the above described misting device without departing from the scope of the invention herein involved, it is intended that all matter contained in the description thereof or shown in the accompanying figures shall be interpreted as illustrative and not in a limiting sense.

What is claimed is:

1. A device for spraying a mist upon a person comprising:

a pressure vessel capable of holding a fluid under pressure;

a fluid fill valve fluidly connected to said pressure vessel and capable of holding fluid under pressure within said pressure vessel when said fill valve is closed;

a CO2 gas cartridge pressurized gas source;

a gas release valve releasably connectable to said pressurized gas source;

said pressurized gas source fluidly connected to said pressure vessel;

a collapsible support structure;

a manifold;

one or more mist nozzles;

said one or more mist nozzles being attached to said support structure; and, said manifold being fluidly connected to said pressure vessel and also to said one or more mist nozzles such that when said pressure vessel is pressurized by opening of said gas release valve connected to said pressurized gas source then the fluid in said pressure vessel is forced into said manifold and out said one or more mist nozzles.

2. The device of claim 1 wherein said support structure is two or more rigid pieces capable of being releasably attached to each other.

3. A device for spraying a mist upon a person comprising:

a pressure vessel capable of holding a fluid under pressure;

a fluid fill valve fluidly connected to said pressure vessel and capable of holding fluid under pressure within said pressure vessel when said fill valve is closed;

a CO2 gas cartridge pressurized gas source;

a gas release valve capable of being foot operated by a foot pedal and releasably connectable to said pressurized gas source;

said pressurized gas source fluidly connected to said pressure vessel;

a support structure;

a manifold;

one or more mist nozzles;

said one or more mist nozzles being attached to said support structure; and, said manifold being fluidly connected to said pressure vessel and also to said one or more mist nozzles such that when said pressure vessel is pressurized by opening of said gas release valve connected to said pressurized gas source then the fluid in said pressure vessel is forced into said manifold and out said one or more mist nozzles.

4. A device for spraying a mist upon a person comprising:

a pressure vessel capable of holding a fluid under pressure;

a fluid fill valve fluidly connected to said pressure vessel and capable of holding fluid under pressure within said pressure vessel when said fill valve is closed;

a CO2 gas cartridge pressurized gas source;

a gas release valve releasably connectable to said pressurized gas source;

said pressurized gas source fluidly connected to said pressure vessel;

a support structure comprising one or more suction cups releasably attachable to a smooth structure such as a wall;

a manifold;

one or more mist nozzles;

said one or more mist nozzles being attached to said one or more suction cups; and, said manifold being fluidly connected to said pressure vessel and also to said one or more mist nozzles such that when said pressure vessel is pressurized by opening of said gas release valve connected to said pressurized gas source then the fluid in said pressure vessel is forced into said manifold and out said one or more mist nozzles.

* * * * *